US005590703A

United States Patent [19]

Eckert

[11] Patent Number: 5,590,703

[45] Date of Patent: Jan. 7, 1997

[54] ALUMINUM SURFACE TREATMENT

[76] Inventor: C. Edward Eckert, 260 Lynn Ann Dr., New Kensington, Pa. 15068

[21] Appl. No.: 423,544

[22] Filed: Apr. 17, 1995

[51] Int. Cl.[6] ..... B22D 11/12

[52] U.S. Cl. ..... 164/476; 164/477

[58] Field of Search ..... 164/476, 477, 164/417, 414, 76.1; 29/527.6, 527.7, 526.2; 72/40; 451/53, 38

[56] References Cited

U.S. PATENT DOCUMENTS

| | | | |
|---|---|---|---|
| 2,239,044 | 12/1938 | Leighton | 72/40 |
| 2,310,703 | 1/1941 | McGliney | 29/527.6 |
| 3,320,701 | 5/1967 | Abrams et al. | 72/40 |
| 3,933,532 | 1/1976 | Glomb | 72/40 |
| 4,420,957 | 12/1983 | Weber | 72/40 |
| 4,532,980 | 8/1985 | Miyawaki et al. | 164/477 |
| 4,705,096 | 11/1987 | Chia | 164/476 |

FOREIGN PATENT DOCUMENTS

| | | |
|---|---|---|
| 59-223111 | 12/1984 | Japan . |
| 60-130414 | 7/1985 | Japan . |

*Primary Examiner*—Joseph J. Hail, III
*Assistant Examiner*—Randolph Sherrich
*Attorney, Agent, or Firm*—Andrew Alexander

[57] ABSTRACT

A method for removing a surface layer from a solidified body of metal at an elevated temperature to remove surface defects therefrom. The method comprises providing a solidified body having a surface wherein the body can have a temperature greater than 200° F. and below the solidus temperature of the metal. The metal surface is contacted with an abrasive material having a particle size in the range of 6 to 300 grit (U.S. Sieve Series). The abrasive material is applied at a flux sufficient to remove a surface layer from the body, the layer having a thickness in the range of 10 to 300 μm to provide a surface substantially free of said surface defects.

22 Claims, No Drawings

ALUMINUM SURFACE TREATMENT

BACKGROUND OF THE INVENTION

This invention relates to metals such as aluminum and to metal ingot, slab, strip or billet and the like. More particularly, it relates to improving the as-cast surface quality of metal ingot, slab, strip, bar or billet and the like to provide cast material having substantially improved metal surface suitable for further processing or fabricating.

During the casting of metal (aluminum) ingot, slab, strip, and other forms, various defects may appear on the surface. These defects can be topographical, solidification related, and contaminant related. Many of these defects develop during the early stages of solidification and within a thin surface layer of solidified metal known as the "shell".

Topographical defects include surface roughness caused by the mold or mold coating material. During the early stages of solidification, the shell is in direct and intimate contact with the mold. If the mold surface exhibits a particular topography, this topography is replicated on the shell and thus causes a surface defect. Solidified metal can also collect on sections of the mold and/or metal entry devices such as nozzles and inscribe striations in the shell. These types of defects are often referred to as "drags".

Solidification related defects include as a condition known as "liquation" wherein cooling of the solidifying shell within the mold results in local contraction of the shell. Contraction occurs in most solidifying metals because the density of solid metal is usually greater than in the molten state. As the surface of the shell retreats from the mold wall, it creates a gap. Local heat transfer is reduced, reheating occurs, and the surface of the shell advances back in the direction of the mold. Heat transfer is again increased, invoking a subsequent retreat. This cyclic process causes undulations in the surface of the shell, and segregation of solute elements in the case of an alloy. The problem is particularly exacerbated by wide freezing range alloys, or alloys with a substantial fraction of eutectic liquid remaining at a temperature corresponding to the eutectic reaction isotherm. If present, secondary phases in the alloy, such as iron aluminides, may also be non-uniformly distributed on the surface of the solidifying shell, as a result of this process. Poor feed metal flow conditions into the mold can also result in solidification related surface defects.

Contaminant related defects are caused by oxides, salts, and combinations of oxides and salts present in the molten metal that form a layer on the shell during solidification. Since these contaminants are immiscible, they readily segregate to the surface. The well known "oxide patches" in the direct chill (DC) casting of magnesium containing aluminum ingot are an example of contaminant related defects.

Several methods directed at preventing surface defects have been disclosed in the literature. Electromagnetic casting is one example. Improved metal flow distribution facilitated by novel nozzle design in continuous slab and strip casting is another example. All of these attempts to solve surface problems are classified as preventative.

Scalping of ingot is a commonly employed remedial practice to establish a surface suitable for rolling. The rolling faces of an ingot are essentially milled, off-line, to depths of 0.25 inch (or greater), prior to hot rolling. Ingot scalping is a capital intensive process that can only be performed on the rolling faces of the ingot. Since the edge surfaces of an ingot are contoured to control stresses during rolling, conventional scalping is not a viable alternative to remove edge defects. The presence of oxide patches on the edges of an ingot constitutes a problem that requires careful hot rolling practices to avoid edge cracking.

Often, it is desirable to remove such defects while the metal is in a hot condition, for example, shortly after casting, particularly in continuous casting systems. However, this has the problem that the metal is plastic, making the treatment thereof difficult. For example, mechanical brushing or burnishing has been found unsatisfactory to remove such defects. Thus, there is a great need for a process to remove the defects relented to, preferably on a continuous basis, to provide a defect-free surface suitable for rolling to provide sheet or plate or like material with a high quality surface.

SUMMARY OF THE INVENTION

It is an object of the invention to provide a process for removing surface defects from metal surfaces.

It is another object of the invention to provide a process for removing defects from metal ingot surfaces such as aluminum ingot.

It is yet another object of the invention to provide a process for removing defects from surfaces of slab such as aluminum slab continuously cast by belt or block casters.

And yet, it is another object of the invention to provide a process for removing defects frown surfaces of strip such as aluminum strip continuously cast by a roll caster such as a twin roll caster.

Still, it is another object of the invention to continuously remove surface defects on continuously cast material such as ingot slab or strip while such material is at an elevated temperature, for example, immediately exiting the casting mold.

In accordance with these objects there is provided a method for removing a surface layer from a solidified body of metal at an elevated temperature to remove surface defects therefrom. The method comprises providing a solidified body having a surface wherein the body can have a temperature greater than 200° F. and below the solidus temperature of the metal. The metal surface is contacted with an abrasive material having a particle size in the range of 6 to 300 grit (U.S. Sieve Series). The abrasive material is applied at a flux sufficient to remove a surface layer from the body, the layer having a thickness in the range of 10 to 300 μm to provide a surface substantially free of said surface defects.

DETAILED DESCRIPTION OF THE PREFERRED EMBODIMENTS

The surface treatment of hot as-cast metal shapes is difficult due to the high plasticity of metal at elevated temperatures. Further, the controlled removal of material from a contoured surface of an as-cast shape is not easily accomplished if the contour is to be maintained. A combination of both scenarios considerably exacerbates the situation.

Thus, the method of the present invention removes a surface layer from a solidified body of metal at an elevated temperature to remove surface defects therefrom. The method also includes removing the layer at room temperature. In the method, the solidified bodies can have a surface at a temperature greater than 200° F. and below the solidus temperature of the metal, and surface defects can be removed therefrom efficiently and economically utilizing the present invention. In the invention, the surface is contacted with an abrasive material having a particle size in the range of 6 to 300 grit (U.S. Sieve Series). The abrasive material is applied at a flux sufficient to remove the surface layer containing the defects from the body. The layer removed from the surface can have a depth or thickness in the range of 10 to 300 μm. In the present invention, the surface can be moving past the flux or the flux can be moving across a stationary surface to remove the surface layer.

In accordance with the present invention, a working medium is accelerated to high velocity and impacted on the surface of the cast shape (hereafter, target) for treatment of said target. This acceleration can be accomplished by pneumatic or centrifugal/mechanical means. A medium scavenging system is provided at the target to collect rebounding media for recycling. Material removed from the target as a result of this treatment is also collected and separated. An integral reflectometer or surface profilometer can be incorporated to control the treatment process.

The media is preferably benign to the accompanying processing equipment. In the case of aluminum processing, steel, aluminum or polymeric shot is suitable. Such media, if inadvertently carried through to a subsequent rolling operation, will not damage work rolls.

The method of the invention can be applied to any metal surface where a very thin layer is to be removed. Such removal can be referred to as mini-scalping or micro-scalping. As noted, the temperature of the metal surface to be subjected to micro-scalping can range from room temperature to temperatures of the metal exiting a casting mold. Thus, micro-scalping in accordance with the invention can be applied to all aluminum alloys, for example, as set forth by the Aluminum Association, steel, copper, lead, titanium, magnesium, and like alloys. The metal surfaces can be substantially flat such as produced by a roll, block or belt caster, or the surface can be curved or contoured such as found on the edges of ingot or billet such as aluminum ingot or billet. Further, micro-scalping can be applied to, for example, aluminum shapes such as extrusion, wire, rod or bar as well as sheet or plate. All are contemplated within the purview of the invention. Further, micro-scalping in accordance with the invention provides a surface, such as a clean surface, suitable for lubricant retention during thermomechanical processing or retention of coatings such conversion coating or organic coatings. Micro-scalping can be used for removing undesirable surface residues to provide a clean surface for later treatments.

When the surface to be treated is metal strip or slab such as aluminum, metal strip or slab, the abrasive material can be applied while the metal surface is in a temperature range of 200° to 1025° F. The temperatures can be lower or higher as the case may be. Further, the abrasive material can be applied while the metal surface travels at a rate in the range of 7 to 120 ft/min with higher or lower rates contemplated, depending on the rate of casting.

In a continuous caster such as a belt caster as set forth in U.S. Pat. No. 3,878,883, incorporated herein by reference, aluminum alloy slab is produced and then hot rolled immediately after casting to stock which can then be wound into rolls. The micro-scalping of the present invention is particularly suitable for application between the casting step and the hot rolling step to eliminate or remove defects prior to hot rolling and without interruption of the casting and rolling process. Likewise, micro-scalping can be applied to sheet material produced by a roll caster such as a Hunter caster and prior to rolling, or it can be applied to bar stock such as produced on a wheel caster.

The abrasive material can be of a size and shape as required to remove the particular metal being treated. For aluminum or steel particles having a size of 6 to 300 grit (U.S. Sieve series) is particularly suitable for treating aluminum surfaces. Further, spherical particles may be used. However, angular particles with sharp edges are particularly suitable for treating surfaces of aluminum. By the term "aluminum" as used herein is meant to include the alloys thereof and the same applied to steel, etc.

The abrasive material may be selected from metals or ceramic material. Further, the metal abrasive material can be selected from steel, aluminum and copper, for example, or mixtures thereof, and the ceramic material can be selected from silica, alumina, or other like material or mixtures thereof. When aluminum surfaces are being treated, particularly suitable abrasive material is aluminum or steel abrasive material. The aluminum has the advantage that it avoids contamination of the surface with foreign matter. Further, it avoids contacting the rolls used for hot rolling with abrasive material that may damage the roll surface. Steel has the advantage that it can be easily separated by magnetics from the aluminum removed from the surface. One or more treatments can be applied to the surface to be micro-scalped. The second treatment can utilize an abrasive material that is benign to remove any foreign residual material remaining after an aggressive treatment such as, for example, silica or alumina treatment.

The abrasive material can be applied as a band across the width of the surface, depending on the strip or slab width. The band width used depends on the speed with which the surface is moving and the amount of surface material to be removed. If the amount of metal to be removed is only 5 or 10 μm, then the band can be relatively narrow. It will be understood that band width and amount of metal removed also depends on the flux. Thus, these parameters can be varied within the constraints of the invention.

The vehicle for applying the abrasive material to the surface can be air pressure which can be varied in intensity, depending on the abrasive material and the amount of metal removed. Or, the abrasive material can be applied with centrifugal force utilizing a wheel which propells the particles towards the surface. It is preferred that abrasive material be applied in a dry condition to avoid excessive cooling of the surface, particularly if it is desired to hot roll immediately after the micro-scalping treatment. Thus, the present invention has the advantage that it can remove the desired amount of metal without detrimental cooling of the metal surface.

In the present invention, the abrasive material can be recaptured or reclaimed by applying vacuum immediately adjacent the band or surface area treated. Thus, a vacuum or air sweep or knife can be applied after the micro-scalping treatment to collect the abrasive material and recirculate it for re-use. Recovering the abrasive material is particularly useful in avoiding damaging rolls and bearings, etc. and other downstream processing equipment.

To further illustrate the invention, it will be seen that at a casting rate of 15 f/min and a slab abrasive band width of 4" results in an effective exposure rate of new surface of 7.0 $ft^2$/min. The discharge rate for a ⅜" diameter nozzle operated at 100 psig is 1150 lb/hr silica or 842 lb/hr (14.0 lb/min) aluminum abrasive material. This results in a sample loading density of 2.8 lb/$ft^2$. A loading density of approximately 3 lb/$ft^2$ can be used to remove 0.001" material using silica at 100 psig, for example.

The mass of a 0.030" diameter aluminum 80 grit shot particle is $1.37\times10^{-5}$ lb, or 732,293 particles/lb media. At a sample loading density of 2.8 lb/ft$^2$, a particle density of $2.06\times10^6$ particles/ft$^2$ results. Using the relationship:

$$C=2[h(2r-h)]^{-1/2}$$

C=spherical segment h=distance from surface r=sphere radius a particle with a spherical radius of 0.015", intersected at a 0.004" depth, creates a projected area of $2.27\times10^{-6}$ ft$^2$. The inverse (440,960 particles) is the number of particles of 0.030" diameter required to cover an area of 1 ft$^2$ at an indentation depth of 0.004". The ratio of actual to required particles is $2.06\times10^6/440{,}960=4.67$.

A perfectly elastic collision between the slab and media particle will not result due to elastic recovery of the materials. Assuming that media approach velocity is 300 ft/sec and an incident rebound velocity of 50 ft/sec occurs with a collision time of 0.001 sec (1000 $H_z$), the normal force imparted by a 0.030" aluminum particle is:

$$F=w/g(V_o-V_f)/t=(1.37\times10^{-6}\ lb/32.2\ ft/sec^2)(300-50\ ft/sec)/0.001\ sec=0.011\ lb_f$$

The kinetic energy of such a particle is:

$$K.E=\tfrac{1}{2}\,mv^2=0.5(1.37\times10^{-6}/32.2)(300)^2=0.0019\ ft\text{-}lb_f$$

Media Specifics:

80 steel grit media, $D_p$=0.030 in $V_p=1.4\times10^{-5}$ in$^3$ (spherical approximation)

$M_p=5.4\times10^{-6}$ lb

Particle Density Requirements:

A density of 727,680 particles/ft$^2$ is required to remove 0.004 in material (spherical radius of 0.015 in intersected at 0.004 in) at 60% efficiency.

(727,680 particles/ft$^2$)($5.4\times10^{-6}$ lb/particle)=3.9 lb/ft$^2$

Media Massflow Rate for Caster:

CR=15 ft/min

Width=2.8 in=2.32 ft

Area renewal rate=(1.5 ft/min)(2.33 ft/side)(2 sides)=69.9 ft$^2$/min

Media massflow rate=(3.9 lb/ft$^2$)(69.9 ft$^2$/min(=273 lb/min

It will be seen that the abrasive material applied in accordance with the above calculation is effective in transforming a defective surface to a surface free of defects. Further, the process of the invention permits the use of cast material which otherwise would be scrapped or have greatly lowered value. The process can be controlled to remove only the minimum amount of metal and thus results in only minimal amounts of surface metal being scrapped or lost. In addition, the process can be controlled to change the flux and the amount of metal removed, depending on the depth of the defects.

While the invention has been described in terms of preferred embodiments, the claims appended hereto are intended to encompass other embodiments which fall within the spirit of the invention.

What is claimed is:

1. A method of removing a surface layer from a solidified body of aluminum alloy metal at an elevated temperature to remove surface defects therefrom, the method comprising:

(a) providing a solidified body having a surface, the body at a temperature greater than 200° F. and below the solidus temperature of the metal;

(b) contacting said surface with an abrasive material having a particle size in the range of 6 to 300 grit (U.S. Sieve Series); and (c) applying said abrasive material at a flux sufficient to remove a surface layer of metal from said body, said surface layer of metal removed having a thickness in the range of 10 to 300 μm to provide a surface substantially free of said surface defects and then rolling said body.

2. The method in accordance with claim 1 including the steps of:

(a) casting said body of metal continuously into a solidified strip or slab;

(b) applying said abrasive material continuously across a surface thereof at a flux sufficient to remove defects while said strip or slab is hot; and (c) thereafter continuously rolling said strip or slab.

3. The method in accordance with claim 1 wherein said metal is an aluminum alloy strip or slab exiting a continuous casting operation including a roll caster or belt caster.

4. The method in accordance with claim 3 wherein said body is at a temperature in the range of 200° to 1025° F.

5. The method in accordance with claim 3 wherein said strip or slab is moving at a rate of 7 to 120 ft/min.

6. The method in accordance with claim 3 including rolling said strip or slab immediately after removing said surface layer while said strip or slab is maintained at a temperature above 200° F.

7. In a process for continuously casting a molten aluminum alloy metal into a strip, slab or bar wherein molten aluminum alloy metal is introduced to a continuously advancing mold and a solidified strip, slab or bar is removed from said mold, the strip, slab or bar having a surface having defects therein, the improvement comprising:

(a) contacting said surface of said strip, slab or bar with an abrasive particle material when strip, slab or bar is above 200° F. and immediately after said strip, slab or bar exits said mold, said abrasive material having a particle size in the range of 6 to 300 grit (U.S. Sieve Series); and (b) applying said abrasive material at a flux sufficient to remove a layer of aluminum alloy metal from said surface, the layer having a thickness in the range of 10 to 300 μm thereafter rolling said strip, slab or bar.

8. The method in accordance with claim 7 including selecting said abrasive particle material from the group consisting of metal and ceramic abrasive particle material.

9. The method in accordance with claim 7 including selecting said abrasive particle material from the group consisting of steel, aluminum, copper, polymeric, silica and alumina abrasive particle material.

10. The method in accordance with claim 7 including using abrasive material having a shape which is spheroidal or angular.

11. The method in accordance with claim 7 including contacting said surface when said strip, slab or bar has a temperature greater than 200° F. and prior to rolling said strip or slab.

12. The method in accordance with claim 7 maintaining said body at a temperature in the range of 200° to 1025° F. prior to applying said abrasive material.

13. The method in accordance with claim 7wherein said strip or slab is moving at a rate of 7 to 120 ft/min.

14. The method in accordance with claim 7 wherein said strip or slab is moving at a rate of 12 to 80 ft/min.

15. In a process for casting molten aluminum alloy into a strip or slab wherein molten aluminum alloy is introduced to a continuously advancing mold and a solidified strip or slab is continuously removed from said mold, thereafter said strip or slab is rolled while hot, the strip or slab exiting said mold having a surface for treating to remove defects therefrom prior to rolling said strip or slab, the improvement comprising:

(a) maintaining said strip or slab at a temperature greater than 200° F.;

(b) continuously contacting said surface with an abrasive particle material prior to hot rolling said strip or slab, said abrasive particle material having a particle size in the range of 6 to 300 grit (U.S. Sieve Series);

(c) continuously applying said abrasive material at a flux sufficient to remove a layer of aluminum alloy metal from said surface, the layer having a thickness in the range of 10 to 300 μm; and (d) continuously hot rolling said strip or slab after said layer of aluminum alloy metal is removed.

16. The method in accordance with claim 15 including selecting said abrasive particle material from the group consisting of metal and ceramic abrasive particle material.

17. The method in accordance with claim 15 including selecting said abrasive particle material from the group consisting of steel, aluminum, copper, polymeric, silica and alumina abrasive particle material.

18. The method in accordance with claim 15 including using abrasive material having a shape which is spheroidal or angular.

19. The method in accordance with claim 15 wherein said strip or slab is provided at a temperature in the range of 200° to 1025° F.

20. The method in accordance with claim 15 wherein said strip or slab is moving at a rate of 7 to 120 ft/min.

21. The method in accordance with claim 15 wherein said strip or slab is moving at a rate of 12 to 80 ft/min.

22. A method of removing a surface layer from an ingot of aluminum to remove surface defects therefrom, the method comprising:

(a) providing an ingot having a surface, the ingot maintained at a temperature greater than 200° F.;

(b) contacting said surface with an abrasive material having a particle size in the range of 6 to 300 grit (U.S. Sieve Series); and (c) applying said material at a flux sufficient to remove a surface layer of aluminum metal from said ingot having a thickness in the range of 10 to 300 μm to provide a surface substantially free of said surface defects and then rolling said ingot.

* * * * *